US010390168B2

(12) United States Patent
Hung

(10) Patent No.: US 10,390,168 B2
(45) Date of Patent: Aug. 20, 2019

(54) AUDIO ENHANCEMENT DEVICE AND METHOD

(71) Applicant: Realtek Semiconductor Corporation, Hsinchu (TW)

(72) Inventor: Tien-Chiu Hung, New Taipei (TW)

(73) Assignee: REALTEK SEMICONDUCTOR CORPORATION, Hsinchu (TW)

( * ) Notice: Subject to any disclaimer, the term of this patent is extended or adjusted under 35 U.S.C. 154(b) by 0 days.

(21) Appl. No.: 16/057,991

(22) Filed: Aug. 8, 2018

(65) Prior Publication Data

US 2019/0069116 A1 Feb. 28, 2019

(30) Foreign Application Priority Data

Aug. 24, 2017 (TW) ..... 106128797 A

(51) Int. Cl.

| | |
|---|---|
| ***H04S 7/00*** | (2006.01) |
| ***H04S 1/00*** | (2006.01) |
| ***H04R 3/14*** | (2006.01) |
| ***H04R 3/04*** | (2006.01) |

(52) U.S. Cl.

CPC ..... *H04S 7/303* (2013.01); *H04R 3/04* (2013.01); *H04R 3/14* (2013.01); *H04S 7/302* (2013.01); *H04S 7/307* (2013.01); *H04S 1/007* (2013.01); *H04S 2400/05* (2013.01)

(58) Field of Classification Search

CPC ..... H04S 7/303; H04S 7/307; H04S 1/007; H04S 2400/05; H04R 3/14; H04R 3/04

See application file for complete search history.

(56) References Cited

U.S. PATENT DOCUMENTS

| | | | | |
|---|---|---|---|---|
| 4,192,969 A * | 3/1980 | Iwahara | H04S 1/002 381/1 |
| 4,748,669 A * | 5/1988 | Klayman | H04S 7/30 369/86 |
| 5,661,808 A | 8/1997 | Klayman | |
| 5,870,480 A * | 2/1999 | Griesinger | H04S 3/02 381/18 |
| 5,872,851 A * | 2/1999 | Petroff | H04S 1/002 381/1 |
| 7,991,176 B2 | 8/2011 | Kirkeby | |
| 8,144,902 B2 | 3/2012 | Johnston | |

(Continued)

*Primary Examiner* — Ping Lee

(74) *Attorney, Agent, or Firm* — Locke Lord LLP; Tim Tingkang Xia, Esq.

(57) ABSTRACT

An audio enhancement device including an audio-calculating module, a ratio-calculating module, a minimum-tracking module, a weighting-calculating module and a mixing module is provided. The audio-calculating module calculates a mid signal and a side signal according to a sum and a difference of an input first channel signal and an input second channel signal. The ratio-calculating module calculates a side-mid ratio of the side signal relative to the mid signal. The minimum-tracking module tracks a side-mid ratio minimum. The weighting-generating module determines a first and a second weighting values according to the side-mid ratio minimum. The mixing module weights the mid signal and the side signal based on the first and the second weighting values respectively and adjusts the input first channel signal and the input second channel signal accordingly to generate an enhanced first channel signal and an enhanced second channel signal.

12 Claims, 5 Drawing Sheets

(56) References Cited

U.S. PATENT DOCUMENTS

| | | | |
|---|---|---|---|
| 9,741,360 | B1 | 8/2017 | Li et al. |
| 2005/0265558 | A1 | 12/2005 | Neoran |
| 2015/0125010 | A1 | 5/2015 | Yang et al. |
| 2015/0172812 | A1 | 6/2015 | Wu |

* cited by examiner

4

AUDIO ENHANCEMENT DEVICE AND METHOD

RELATED APPLICATIONS

This application claims priority to Taiwan Application Serial Number 106128797, filed Aug. 24, 2017, which is herein incorporated by reference.

BACKGROUND

Field of Invention

The present disclosure relates to an audio enhancement technology. More particularly, the present disclosure relates to an audio enhancement device and an audio enhancement method.

Description of Related Art

When a loudspeaker system plays a two-channel signal, the listener senses the direction and the distance of the sound source based on the sound pressure difference, the time difference and the phase difference perceived by the left and the right ears. The stereo effect is thus established. However, when the distance of the two loudspeakers are close, the sound pressure difference, the time difference and the phase difference become smaller. The listener is not able to efficiently determine the position of the sound source due to the narrow sound field. The stereo effect can not be established easily.

Accordingly, what is needed is an audio enhancement device and an audio enhancement method to address the issues mentioned above.

SUMMARY

An aspect of the present disclosure is to provide an audio enhancement device that includes an audio-calculating module, a ratio-calculating module, a minimum-tracking module, a weighting-calculating module and a mixing module. The audio-calculating module is configured to calculate a mid signal and a side signal according to a sum and a difference of an input first channel signal and an input second channel signal respectively. The ratio-calculating module is configured to calculate a side-mid ratio of the side signal relative to the mid signal. The minimum-tracking module is configured to track a side-mid ratio minimum within a certain time period. The weighting-calculating module is configured to determine a first weighting value and a second weighting value according to the side-mid ratio minimum. The mixing module is configured to weight the mid signal and the side signal based on the first weighting value and the second weighting value respectively and adjust the input first channel signal and the input second channel signal accordingly to generate an enhanced first channel signal and an enhanced second channel signal.

Another aspect of the present disclosure is to provide an audio enhancement method that includes the steps outlined below. A mid signal and a side signal are calculated according to a sum and a difference of an input first channel signal and an input second channel signal respectively by an audio-calculating module. A side-mid ratio of the side signal relative to the mid signal is calculated by a ratio-calculating module. A side-mid ratio minimum within a certain time period is tracked by a minimum-tracking module. A first weighting value and a second weighting value are determined according to the side-mid ratio minimum by a weighting-calculating module. The mid signal and the side signal are weighted based on the first weighting value and the second weighting value respectively and the input first channel signal and the input second channel signal are adjusted accordingly to generate an enhanced first channel signal and an enhanced second channel signal by a mixing module.

These and other features, aspects, and advantages of the present invention will become better understood with reference to the following description and appended claims.

It is to be understood that both the foregoing general description and the following detailed description are by examples, and are intended to provide further explanation of the invention as claimed.

BRIEF DESCRIPTION OF THE DRAWINGS

The invention can be more fully understood by reading the following detailed description of the embodiment, with reference made to the accompanying drawings as follows.

DETAILED DESCRIPTION

Figure 1:
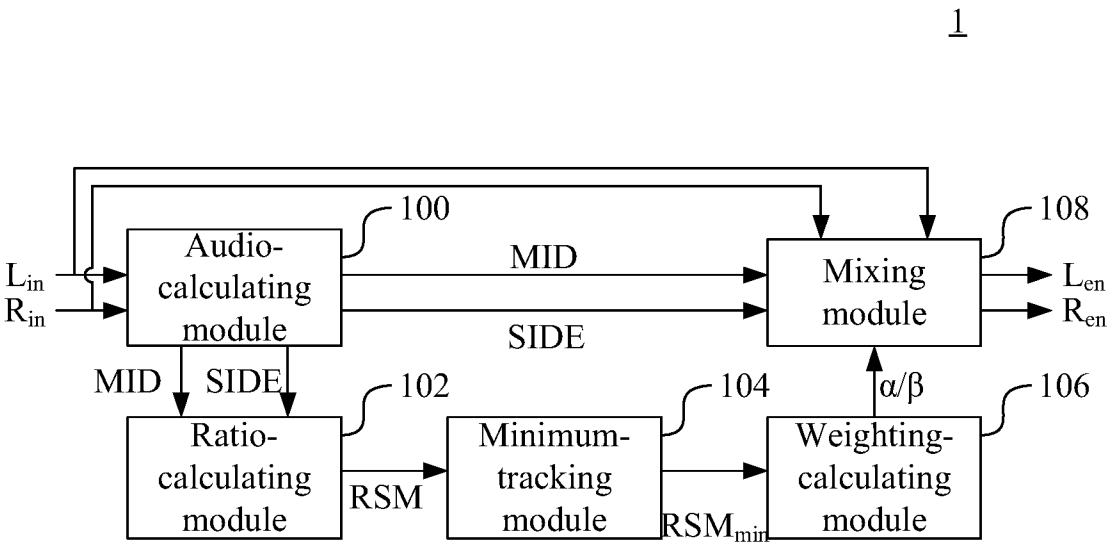
FIG. 1 is a block diagram of an audio enhancement device in an embodiment of the present invention.
Figure 2:
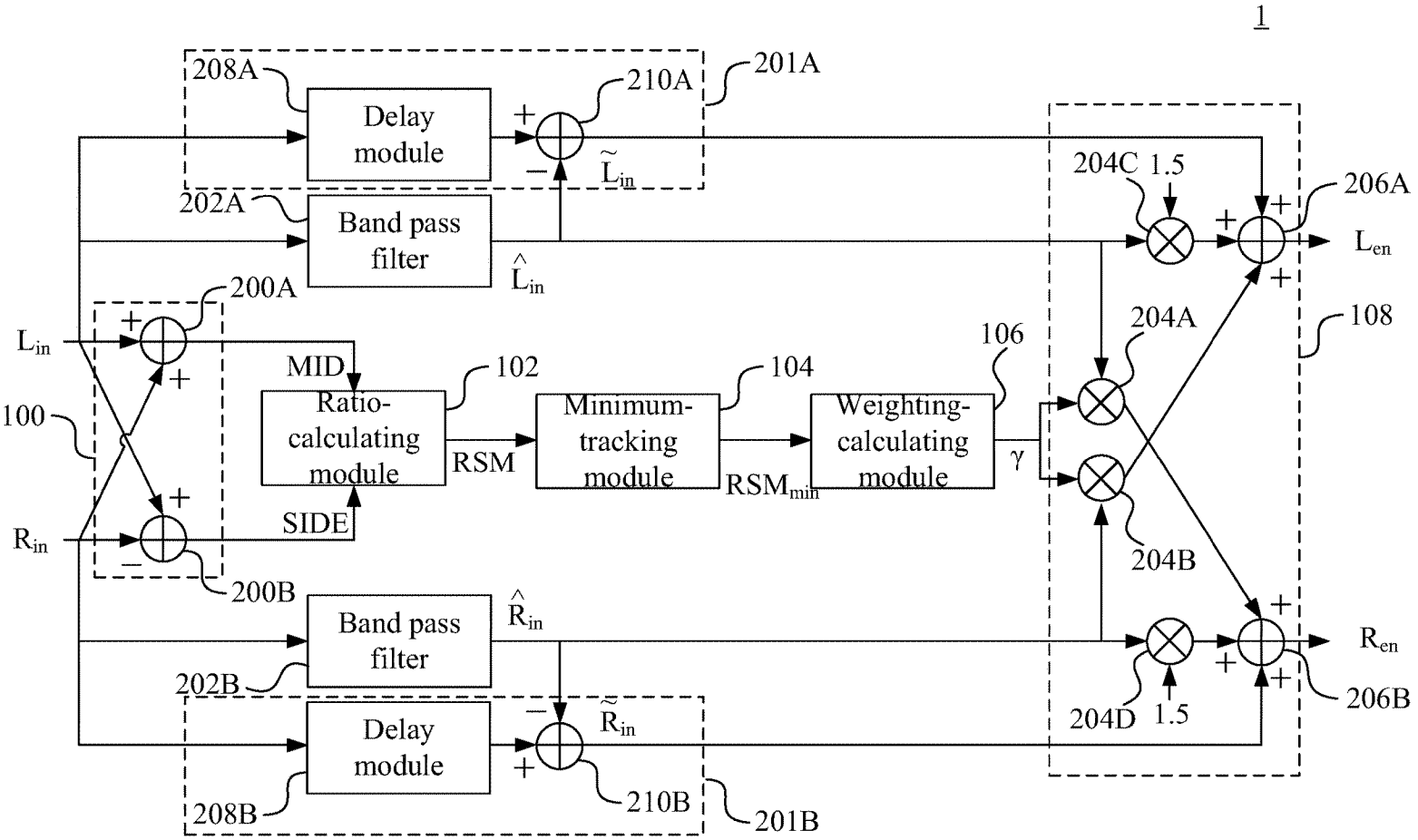
FIG. 2 is a block diagram of the audio enhancement device of an implementation example in an embodiment of the present invention.

Reference is made to FIG. 1 and FIG. 2 at the same time. FIG. 1 is a block diagram of an audio enhancement device 1 in an embodiment of the present invention. FIG. 2 is a block diagram of the audio enhancement device 1 of an implementation example in an embodiment of the present invention.

The audio enhancement device 1 includes an audio-calculating module 100, a ratio-calculating module 102, a minimum-tracking module 104, a weighting-calculating module 106 and a mixing module 108.

The audio-calculating module 100 can be implemented by an operation module that includes such as, but not limited to an adder 200A and an adder 200B illustrated in FIG. 2.

The audio-calculating module 100 is configured to calculate a mid signal MID and a side signal SIDE according to a sum and a difference of an input first channel signal $L_{in}$ and an input second channel signal $R_{in}$ respectively. In an embodiment, the input first channel signal $L_{in}$ and the input second channel signal $R_{in}$ are an input left channel signal and an input right channel signal respectively.

For the listener, the mid signal MID is equivalent to the part of the input first channel signal $L_{in}$ and the input second channel signal $R_{in}$ corresponding to a middle direction and can be expressed as the following equation:

$$\text{MID}=L_{in}+R_{in} \quad \text{(equation 1)}$$

For the listener, the side signal SIDE is equivalent to the part of the input first channel signal $L_{in}$ and the input second channel signal $R_{in}$ corresponding to side directions and can be expressed as the following equation:

$$\text{SIDE}=L_{in}-R_{in} \quad \text{(equation 2)}$$

The ratio-calculating module 102 is configured to calculate a side-mid ratio RSM of the side signal SIDE relative to the mid signal MID.

In an embodiment, the ratio-calculating module 102 divides the absolute value of the side signal SIDE by the absolute value of the mid signal MID to generate the side-mid ratio RSM and can be expressed by the following equation:

$$RSM=\text{SIDE}/\text{MID}=(|L_{in}-R_{in}|)/(|L_{in}+R_{in}|) \quad \text{(equation 3)}$$

In other embodiments, the ratio between the side signal SIDE and the mid signal MID can be replaced by other ways having similar meaning and is not limited by the division of the two signals. For example, the side-mid ratio RSM can be a division of the root mean square of the side signal SIDE and the root mean square of the mid signal MID, or an inverse correlation coefficient between the input first channel signal $L_{in}$ and the input second channel signal $R_{in}$. In an embodiment, when the correlation coefficient is large, i.e. the inverse correlation coefficient is small, the signals from the left channel and the right channel are similar, which makes the listener feels the virtual sound source is in front of the listener. On the contrary, when the correlation coefficient is small, the virtual sound source is from other directions.

The minimum-tracking module 104 is configured to track a side-mid ratio minimum $RSM_{min}$ of the side-mid ratio RSM within a certain time period. For example, the minimum-tracking module 104 can track the side-mid ratio RSM for 5 seconds to retrieve the side-mid ratio minimum $RSM_{min}$ within such a time period.

In an embodiment, the input first channel signal $L_{in}$ and the input second channel signal $R_{in}$ may have rapidly variation that affects the value of the side-mid ratio RSM, such as, but not limited to the unvoiced speech of a conversation. Accordingly, the side-mid ratio minimum $RSM_{min}$ generated by the minimum-tracking module 104 has a high reliability to avoid the error generated due to the foregoing reason or to avoid the severe but rapidly variation observed by the real-time operation.

The weighting-calculating module 106 is configured to determine a first weighting value α and a second weighting value β according to the side-mid ratio minimum $RSM_{min}$. In an embodiment, the audio enhancement device 1 may include a storage unit (not illustrated) configured to store a mapping table. The weighting-calculating module 106 can retrieve the mapping table and determine the first weighting value α and the second weighting value β by looking up the mapping table according to the side-mid ratio minimum $RSM_{min}$.

In other embodiments, the weighting-calculating module 106 can determine first weighting value α and the second weighting value β based on a predetermined algorithm and is not limited by the embodiment described above.

The mixing module 108 is configured to weight the mid signal MID and the side signal SIDE based on the first weighting value α and the second weighting value β respectively and adjust the input first channel signal $L_{in}$ and the input second channel signal $R_{in}$ accordingly to generate an enhanced first channel signal $L_{en}$ and an enhanced second channel signal $R_{en}$.

In an embodiment, the mixing module 108 is configured to add the input first channel signal $L_{in}$ and the weighted mid signal MID to the weighted side signal SIDE to generate the enhanced first channel signal $L_{en}$. The calculation can be expressed as the following equation:

$$L_{en}=L_{in}+\alpha\times0.5\times\text{MID}+\beta\times0.5\times\text{SIDE} \quad \text{(equation 4)}$$

On the other hand, the mixing module 108 is configured to add the input second channel signal $R_{in}$ to the weighted mid signal MID and subtract the weighted side signal SIDE from the added result to generate the enhanced second channel signal $R_{en}$. The calculation can be expressed as the following equation:

$$R_{en}=R_{in}+\alpha\times0.5\times\text{MID}-\beta\times0.5\times\text{SIDE} \quad \text{(equation 5)}$$

In an embodiment, when the side-mid ratio minimum $RSM_{min}$ is larger, the first weighting value α is smaller and the second weighting value β is larger. When the side-mid ratio minimum $RSM_{min}$ is smaller, the first weighting value α is larger and the second weighting value β is smaller.

More specifically, when the side-mid ratio minimum $RSM_{min}$ is larger, the intensity of the side signal SIDE tends to be larger than the intensity of the mid signal MID. In other words, the degree of the difference between the input first channel signal $L_{in}$ and the input second channel signal $R_{in}$ is larger than the degree of the similarity between the input first channel signal $L_{in}$ and the input second channel signal $R_{in}$. Under such a condition, the smaller first weighting value α and the larger second weighting value β makes the difference between the enhanced first channel signal $L_{en}$ and the enhanced second channel signal $R_{en}$ even larger. A more spacious sound effect can be accomplished.

When the side-mid ratio minimum $RSM_{min}$ is smaller, the intensity of the mid signal MID tends to be larger than the intensity of the side signal SIDE. In other words, the degree of the similarity between the input first channel signal $L_{in}$ and the input second channel signal $R_{in}$ is larger than the degree of the difference between the input first channel signal $L_{in}$ and the input second channel signal $R_{in}$. Under such a condition, the larger first weighting value α and the smaller second weighting value β makes the similarity between the enhanced first channel signal $L_{en}$ and the enhanced second channel signal $R_{en}$ even larger. A stronger sound effect from the front side can be accomplished.

In an embodiment, the sum of the first weighting value α and the second weighting value β is 1. For example, when the first weighting value α is 0.9, the second weighting value β is 0.1. When the first weighting value α is 0.3, the second weighting value β is 0.7. However, the present invention is not limited thereto.

In an example of implementation, the first weighting value α and the second weighting value β described above only affect a specific frequency band of the input first channel signal $L_{in}$ and the input second channel signal $R_{in}$. As a result, the audio enhancement device 1 can further include band pass filters 202A and 202B as illustrated in FIG. 2 to perform band pass filtering to filter the input first channel signal $L_{in}$ and the input second channel signal $R_{in}$ to generate a filtered input first channel signal $\hat{L}_{in}$ and a filtered input second channel signal $\hat{R}_{in}$.

The original input first channel signal $L_{in}$ is expressed as:

$$L_{in}=\tilde{L}_{in}+\hat{L}_{in}$$

The original input second channel signal $R_{in}$ is expressed as:

$$R_{in}=\tilde{R}_{in}+\hat{R}_{in}$$

$\tilde{L}_{in}$ is the signal that does not include the filtered input first channel signal $\hat{L}_{in}$. $\tilde{R}_{in}$ is the signal that does not include the filtered input second channel signal $\hat{R}_{in}$.

The equation 4 can be further expressed as:

$$\begin{aligned} L_{en} &= L_{in} + a \times 0.5 \times (\hat{L}_{in} + \hat{R}_{in}) + \beta \times 0.5 \times (\hat{L}_{in} - \hat{R}_{in}) \\ &= \tilde{L}_{in} + \hat{R}_{in} + 0.5 \times (a + 1 - a) \times \hat{L}_{in} + 0.5 \times \\ &\quad (a - 1 + a) \times \hat{R}_{in} \\ &= \tilde{L}_{in} + 1.5 \times \hat{L}_{in} + 0.5 \times \gamma \times \hat{R}_{in} \end{aligned} \quad \text{(equation 6)}$$

The equation 5 can be further expressed as:

$$\begin{aligned} R_{en} &= R_{in} + \alpha \times 0.5 \times (\hat{L}_{in} + \hat{R}_{in}) - \beta \times 0.5 \times (\hat{L}_{in} - \hat{R}_{in}) \\ &= \tilde{R}_{in} + \hat{R}_{in} + 0.5 \times (a - 1 + a) \times \hat{L}_{in} - 0.5 \times \\ &\quad (a + 1 - a) \times \hat{R}_{in} \\ &= \tilde{R}_{in} + 1.5 \times \hat{R}_{in} + 0.5 \times \gamma \times \hat{L}_{in} \end{aligned} \quad \text{(equation 7)}$$

$\gamma=2\times\alpha-1$. In other words, the first weighting value $\alpha$ equals to $(\gamma+1)/2$. The second weighting value $\beta$ equals to $1-(\gamma+1)/2$. As a result, in the present embodiment, the weighting-calculating module 106 can determine $\gamma$ based on the side-mid ratio minimum $RSM_{min}$ and indirectly determine the first weighting value $\alpha$ and the second weighting value $\beta$.

As a result, in the present example of implementation, the mixing module 108 further includes multipliers 204A, 204B, 204C, 204D and adders 206A and 206B, as illustrated in FIG. 2.

After the weighting-calculating module 106 determines $\gamma$, the parameter $\gamma$ is multiplied by $\hat{L}_{in}$ and $\hat{R}_{in}$ generated by the band pass filters 202A and 202B by the multipliers 204A and 204B to generate the terms of $0.5\times\gamma\times\hat{L}_{in}$ and $0.5\times\gamma\times\hat{R}_{in}$.

Besides, the parameters $\hat{L}_{in}$ and $\hat{R}_{in}$ are multiplied by 1.5 by the multipliers 204C and 204D to generate the terms of $1.5\times\hat{L}_{in}$ and $1.5\times\hat{R}_{in}$.

In order to generate the signals $\tilde{L}_{in}$ and $\tilde{R}_{in}$ that do not include the filtered input first channel signal $\hat{L}_{in}$ and the filtered input second channel signal $\hat{R}_{in}$, the audio enhancement device 1 further includes band rejection filters 201A and 201B.

According to an embodiment, the band rejection filter 201A includes a delay module 208A and an adder 210A. The band rejection filter 201B includes a delay module 208B and an adder 210B. The delay modules 208A and 208B are configured to delay the original input first channel signal $L_{in}$ and the input second channel signal $R_{in}$ to match the delay effect caused by the band pass filters 202A and 202B. The delayed signals are further processed by the adders 210A and 210B to remove the terms $\hat{L}_{in}$ and $\hat{R}_{in}$ generated by the band pass filters 202A and 202B to generate the terms $\tilde{L}_{in}$ and $\tilde{R}_{in}$, in which the terms $\tilde{L}_{in}$ and $\tilde{R}_{in}$ are residue signals residue from the delayed signals after the removal of the terms $\hat{L}_{in}$ and $\hat{R}_{in}$. In other embodiments, the band rejection technique for generating the signals $\tilde{L}_{in}$ and $\tilde{R}_{in}$, that do not include the filtered input first channel signal $\hat{L}_{in}$ and the filtered input second channel signal $\hat{R}_{in}$ can be implemented by other methods and is not limited to the delay and the subtraction processes mentioned above.

Furthermore, the adder 206A sums up the terms of $\tilde{L}_{in}$, $1.5\times\hat{L}_{in}$ and $0.5\times\gamma\times\hat{R}_{in}$ to accomplish the operation result of the equation 6 to generate the enhanced first channel signal $L_{en}$.

On the other hand, the adder 206B sums up the terms of $\tilde{R}_{in}$, $1.5\times\hat{R}_{in}$ and $0.5\times\gamma\times\hat{L}_{in}$, to accomplish the operation result of the equation 7 to generate the enhanced second channel signal $R_{en}$.

It is appreciated that the configuration of the modules in FIG. 2 is only an example of implementation. In other embodiments, other configurations and modules can be used to realize the function described above. The present invention is not limited thereto. For example, in another embodiment, the weighting-calculating module 106 can determine the first weighting value $\alpha$ and the second weighting value $\beta$ without using $\gamma$ and perform weighting on the mid signal MID and the side signal SIDE using multipliers.

The audio enhancement device 1 of the present invention can obtain the relation of the side signal SIDE relative to the mid signal MID by calculating the side-mid ratio RSM and further track the side-mid ratio minimum $RSM_{min}$ to avoid the mistaken judgment due to the temporary sound. Further, by weighing the mid signal MID and the side signal SIDE according to the side-mid ratio minimum $RSM_{min}$, the audio enhancement device 1 can adjust the input first channel signal $L_{in}$ and the input second channel signal $R_{in}$ to enhance the characteristic of the sound field to produce a better auditory result.

Figure 3:
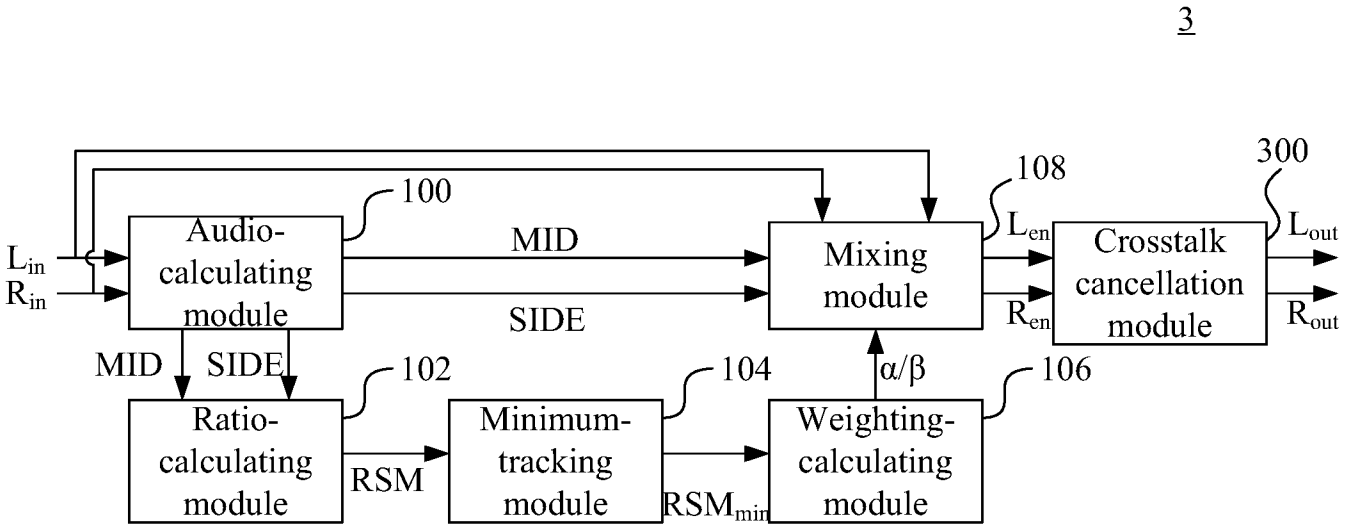
FIG. 3 is a block diagram of an audio enhancement device in an embodiment of the present invention.

Reference is now made to FIG. 3. FIG. 3 is a block diagram of an audio enhancement device 3 in an embodiment of the present invention. The audio enhancement device 3 is similar to the audio enhancement device 1 illustrated in FIG. 1 and includes the audio-calculating module 100, the ratio-calculating module 102, the minimum-tracking module 104, the weighting-calculating module 106 and the mixing module 108. However, the audio enhancement device 3 in FIG. 3 further includes a crosstalk cancellation module 300.

The crosstalk cancellation module 300 is configured to receive the enhanced first channel signal $L_{en}$ and the enhanced second channel signal $R_{en}$ to perform crosstalk cancellation. For example, when the enhanced first channel signal $L_{en}$ and the enhanced second channel signal $R_{en}$ correspond to the left channel and the right channel and the two loudspeakers are positioned closely, the differences of the sound pressures and the arrival times of the signals from the loudspeakers to the opposite side ear are small such that the listener may sense the wrong direction of the sound by the unwanted coloration. As a result, the crosstalk cancellation module 300 can perform the crosstalk cancellation to cancel such an effect to generate an output first channel signal $L_{out}$ and an output second channel signal $R_{out}$ respectively.

In different embodiments, the crosstalk cancellation module 300 may perform crosstalk cancellation using recursive processing or non-recursive processing.

During the crosstalk cancellation procedure, the mid signal MID is easily attenuated. Under the condition that the side-mid ratio minimum $RSM_{min}$ is smaller, the larger first weighting value $\alpha$ and the smaller second weighting value $\beta$ not only enhance the similarity between the enhanced first channel signal $L_{en}$ and the enhanced second channel signal $R_{en}$ to generate stronger auditory effect from the front side, but also compensate the attenuation caused by the crosstalk cancellation module 300.

Figure 4:
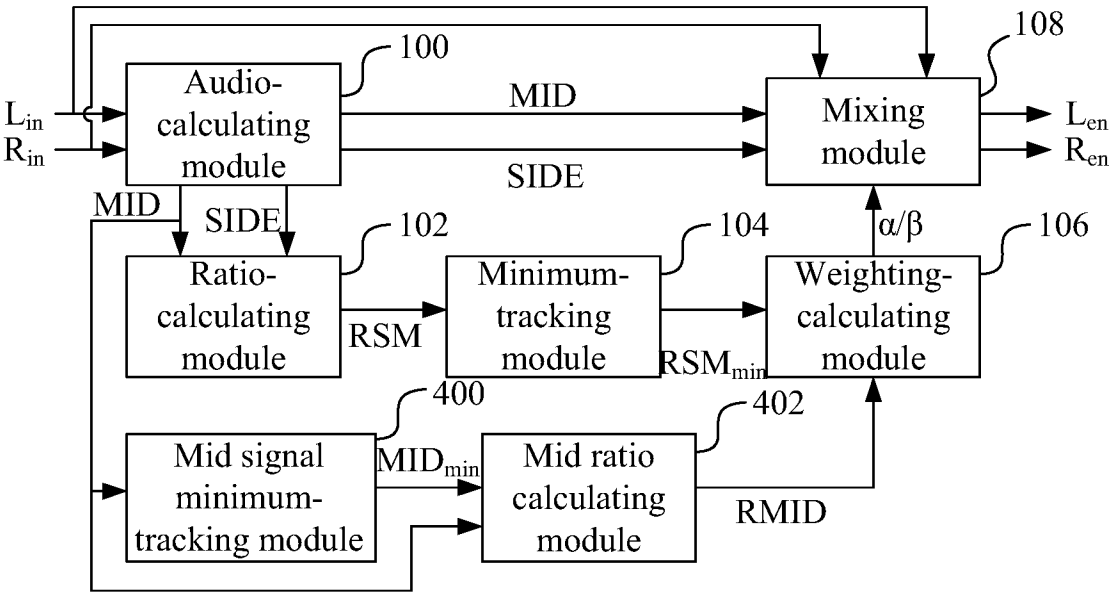
FIG. 4 is a block diagram of an audio enhancement device in an embodiment of the present invention.

Reference is now made to FIG. 4. FIG. 4 is a block diagram of an audio enhancement device 4 in an embodiment of the present invention. The audio enhancement device 4 is similar to the audio enhancement device 1 illustrated in FIG. 1 and includes the audio-calculating module 100, the ratio-calculating module 102, the minimum-tracking module 104, the weighting-calculating module 106 and the mixing module 108. However, the audio enhancement device 4 in FIG. 4 further includes a mid signal minimum-tracking module 400 and a mid ratio calculating module 402.

The mid signal minimum-tracking module 400 is configured to track a mid signal minimum $MID_{min}$ of the mid signal MID within a certain time period. For example, the mid signal minimum-tracking module 400 can track the value, e.g. the absolute value, of the mid signal MID within 5 seconds to retrieve the mid signal minimum $MID_{min}$ within such a time period.

Further, the mid ratio calculating module 402 is configured to calculate a mid ratio RMID of the absolute value of the mid signal MID relative to the mid signal minimum $MID_{min}$ and the calculation can be expressed by the following equation:

$$RMID=|MID|/MID_{min} \quad \text{(equation 8)}$$

In an embodiment, the calculation of the mid ratio RMID is equivalent to the calculation of the signal to noise ratio (SNR). The large value of the mid ratio RMID stands for the sound generated from the front direction.

As a result, the weighting-calculating module 106 of the audio enhancement device 4 is configured to determine the first weighting value $\alpha$ and the second weighting value $\beta$ based on both the side-mid ratio minimum $RSM_{min}$ and the mid ratio RMID. For example, a sound, e.g. a beginning of a speech, is generated from the front side when the mid ratio RMID is larger than a threshold value. Under such a condition, no matter what the value of the side-mid ratio minimum $RSM_{min}$ is, the largest value of the first weighting value $\alpha$ is selected from the mapping table. When the mid ratio RMID is not larger than the threshold value, the first weighting value $\alpha$ can be determined based on the side-mid ratio minimum $RSM_{min}$.

Figure 5:
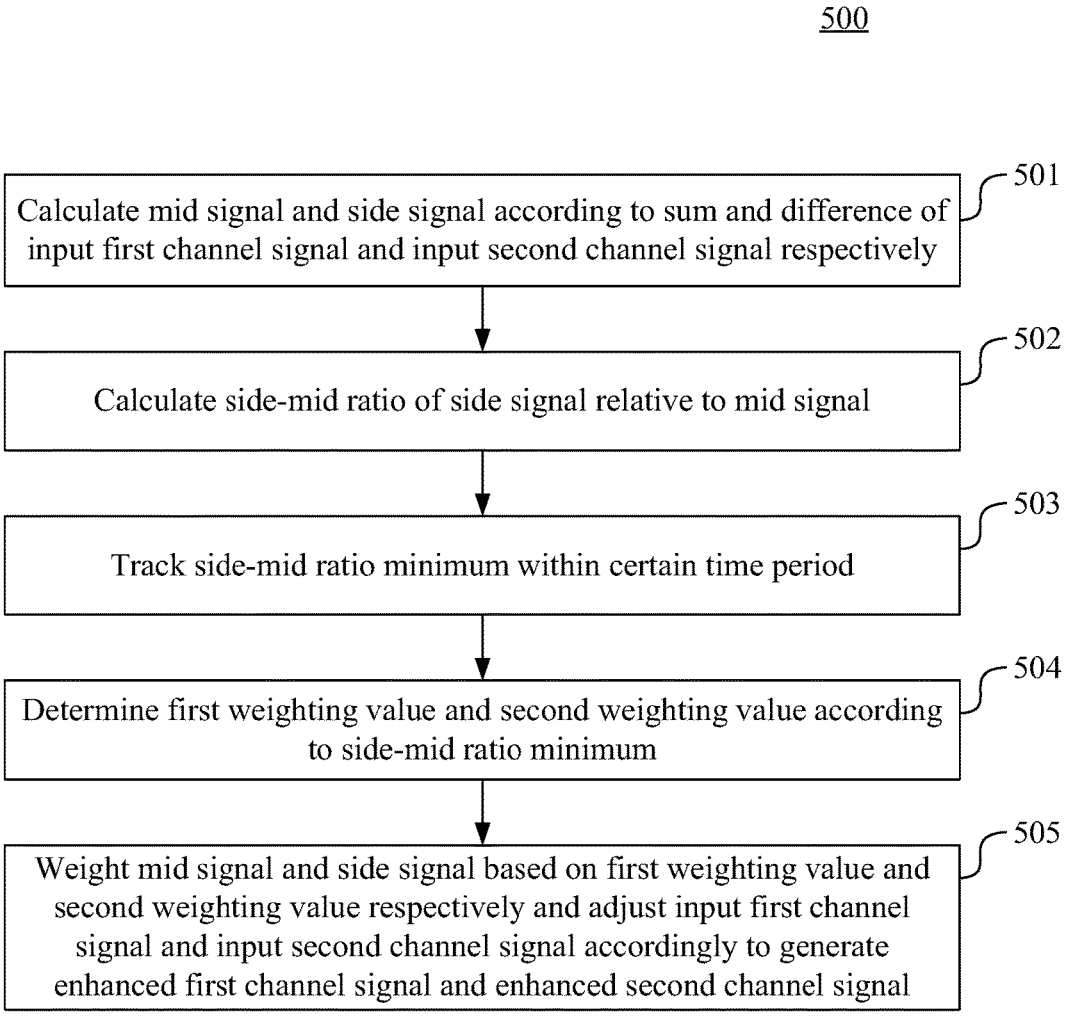
FIG. 5 is a flow chart of an audio enhancement method in an embodiment of the present invention.

Reference is now made to FIG. 5. FIG. 5 is a flow chart of an audio enhancement method 500 in an embodiment of the present invention. The audio enhancement method 500 includes the steps outlined below (The steps are not recited in the sequence in which the steps are performed. That is, unless the sequence of the steps is expressly indicated, the sequence of the steps is interchangeable, and all or part of the steps may be simultaneously, partially simultaneously, or sequentially performed).

In step 501, the audio-calculating module 100 calculates the mid signal MID and the side signal SIDE according to a sum and a difference of the input first channel signal $L_{in}$ and the input second channel signal $R_{in}$ respectively.

In step 502, the ratio-calculating module 102 calculates the side-mid ratio RSM of the side signal SIDE relative to the mid signal MID.

In step 503, the minimum-tracking module 104 tracks the side-mid ratio minimum $RSM_{min}$ within a certain time period.

In step 504, the weighting-calculating module 106 determines the first weighting value $\alpha$ and the second weighting value $\beta$ according to the side-mid ratio minimum $RSM_{min}$.

In step 505, the mixing module 108 weights the mid signal MID and the side signal SIDE based on the first weighting value $\alpha$ and the second weighting value $\beta$ respectively and adjusts the input first channel signal $L_{in}$ and the input second channel signal $R_{in}$ accordingly to generate the enhanced first channel signal $L_{en}$ and the enhanced second channel signal $R_{en}$.

Although the present invention has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

It is appreciated that each of the modules or the steps described above can be implemented by using hardware, software or firmware based on the requirements of the designer.

What is claimed is:

1. An audio enhancement device, comprising:

an audio-calculating module configured to calculate a mid signal and a side signal according to a sum and a difference of an input first channel signal and an input second channel signal respectively;

a ratio-calculating module configured to calculate a side-mid ratio of the side signal relative to the mid signal;

a minimum-tracking module configured to track a side-mid ratio minimum within a certain time period;

a weighting-calculating module configured to determine a first weighting value and a second weighting value according to the side-mid ratio minimum; and a mixing module configured to weight the mid signal and the side signal based on the first weighting value and the second weighting value respectively and adjust the input first channel signal and the input second channel signal based on the weighted mid signal and weighted side signal to generate an enhanced first channel signal and an enhanced second channel signal.

2. The audio enhancement device of claim 1, wherein the mixing module is further configured to add the weighted mid signal and the input first channel signal to the weighted side signal, and further configured to add the weighted mid signal to the input second channel signal to generate an added result and subtract the weighted side signal from the added result;

wherein when the side-mid ratio minimum is larger, the first weighting value is smaller and the second weighting value is larger, and when the side-mid ratio minimum is smaller, the first weighting value is larger and the second weighting value is smaller.

3. The audio enhancement device of claim 1, wherein the first weighting value and the second weighting value are determined by looking up to a mapping table according to the side-mid ratio minimum, and the sum of the first weighting value and the second weighting value is 1.

4. The audio enhancement device of claim 1, further comprising:

a first band pass filter configured to filter the input first channel signal to generate a filtered input first channel signal;

a first band rejection filter configured to delay the input first channel signal and further subtract the filtered input first channel signal from the delayed input first channel signal to generate a first residue signal;

a second band pass filter configured to filter the input second channel signal to generate a filtered input second channel signal;

a second band rejection filter configured to delay the input second channel signal and further subtract the filtered input second channel signal from the delayed input second channel signal to generate a second residue signal;

wherein the mixing module weights the filtered input first channel signal and the filtered input second channel signal according to the first weighting value and the second weighting value respectively and further adds the first residue signal and the second residue signal to the weighted filtered input first channel signal and the weighted filtered input second channel signal respectively to generate the enhanced first channel signal and the enhanced second channel signal.

5. The audio enhancement device of claim 1, further comprising:

a crosstalk cancellation module configured to receive the enhanced first channel signal and the enhanced second channel signal to perform crosstalk cancellation to generate an output first channel signal and an output second channel signal respectively.

6. The audio enhancement device of claim 1, further comprising:

a mid signal minimum-tracking module configured to track a mid signal minimum within the certain time period; and a mid ratio calculating module configured to calculate a mid ratio of the mid signal relative to the mid signal minimum;

wherein the weighting-calculating module determines the first weighting value and the second weighting value according to the side-mid ratio minimum and the mid ratio.

7. An audio enhancement method, comprising:

calculating a mid signal and a side signal according to a sum and a difference of an input first channel signal and an input second channel signal respectively by an audio calculating module:

calculating a side-mid ratio of the side signal relative to the mid signal by a ratio calculating module:

tracking a side-mid ratio minimum within a certain time period by a minimum-tracking module:

determining a first weighting value and a second weighting value according to the side-mid ratio minimum by a weighting-calculating module: and weighting the mid signal and the side signal based on the first weighting value and the second weighting value respectively and adjusting the input first channel signal and the input second channel signal based on the weighted mid signal and weighted side signal to generate an enhanced first channel signal and an enhanced second channel signal by a mixing module.

8. The audio enhancement method of claim 7, further comprising:

adding the weighted mid signal and the input first channel signal to the weighted side signal by the mixing module; and adding the weighted mid signal to the input second channel signal to generate an added result and subtract the weighted side signal from the added result by the mixing module;

wherein when the side-mid ratio minimum is larger, the first weighting value is smaller and the second weighting value is larger, and when the side-mid ratio minimum is smaller, the first weighting value is larger and the second weighting value is smaller.

9. The audio enhancement method of claim 7, wherein the first weighting value and the second weighting value are determined by looking up to a mapping table according to the side-mid ratio minimum, and the sum of the first weighting value and the second weighting value is 1.

10. The audio enhancement method of claim 7, further comprising:

filtering the input first channel signal to generate a filtered input first channel signal by a first band pass filter;

delaying the input first channel signal and further subtracting the filtered input first channel signal from the delayed input first channel signal to generate a first residue signal by a first band rejection filter;

filtering the input second channel signal to generate a filtered input second channel signal by a second band pass filter;

delaying the input second channel signal and further subtracting the filtered input second channel signal from the delayed input second channel signal to generate a second residue signal by a second band rejection filter;

weighting the filtered input first channel signal and the filtered input second channel signal according to the first weighting value and the second weighting value respectively and further adding the first residue signal and the second residue signal to the weighted filtered input first channel signal and the weighted filtered input second channel signal respectively to generate the enhanced first channel signal and the enhanced second channel signal by the mixing module.

11. The audio enhancement method of claim 7, further comprising:

receiving the enhanced first channel signal and the enhanced second channel signal to perform crosstalk cancellation to generate an output first channel signal and an output second channel signal respectively by a crosstalk cancellation module.

12. The audio enhancement method of claim 7, further comprising:

tracking a mid signal minimum within the certain time period by a mid signal minimum-tracking module;

calculating a mid ratio of the mid signal relative to the mid signal minimum by a mid ratio calculating module; and determining the first weighting value and the second weighting value according to the side-mid ratio minimum and the mid ratio by the weighting-calculating module.

* * * * *